US005865491A

United States Patent [19]

Lee

[11] Patent Number: 5,865,491

[45] Date of Patent: Feb. 2, 1999

[54] ROTATABLE HOISTING DEVICE FOR POSITION ADJUSTMENT

[76] Inventor: Kou-An Lee, No. 851, Chung-Shan Rd., Nan-Shing Tsun, Kui-Jen Hsiang, Tainan Hsien, Taiwan

[21] Appl. No.: 905,819

[22] Filed: Aug. 4, 1997

[51] Int. Cl.[6] ..... B66C 13/08

[52] U.S. Cl. ..... 294/67.5; 294/81.4; 294/86.41

[58] Field of Search ..... 294/67.5, 67.21, 294/67.33, 81.3, 81.4, 81.52, 81.56, 82.11, 82.12, 82.15, 86.41, 81.54

[56] References Cited

U.S. PATENT DOCUMENTS

| | | | |
|---|---|---|---|
| 1,577,283 | 3/1926 | Mitchell | 294/82.15 |
| 1,615,115 | 1/1927 | Durhan, Jr. | 294/67.33 |
| 2,823,944 | 2/1958 | Anderson et al. | 294/82.15 |
| 3,046,046 | 7/1962 | Gris | 294/82.15 |
| 3,199,911 | 8/1965 | Alliot et al. . | |
| 3,231,303 | 1/1966 | Le Tourneau | 294/86.41 |
| 3,388,942 | 6/1968 | Johnsson et al. . | |
| 3,485,388 | 12/1969 | Bohne . | |
| 3,902,614 | 9/1975 | Roberts et al. | 294/86.41 |
| 4,253,695 | 3/1981 | Blaive et al. . | |
| 4,768,911 | 9/1988 | Balter | 294/86.41 |
| 5,071,184 | 12/1991 | Dessaux | 294/82.15 |
| 5,125,707 | 6/1992 | Chaen et al. | 294/82.15 |
| 5,762,815 | 6/1998 | Lee . | |

*Primary Examiner*—Dean Kramer
*Attorney, Agent, or Firm*—Baker & Botts, L.L.P.

[57] ABSTRACT

A rotatable hoisting device includes a hanging unit with a hook, and a rotary shaft which is connected to the hanging unit. The rotary shaft is driven by a power drive unit for rotating and adjusting the hanging unit, thereby rotating a form hung on the hook to a desired angular position before it is positioned.

6 Claims, 2 Drawing Sheets

ROTATABLE HOISTING DEVICE FOR POSITION ADJUSTMENT

BACKGROUND OF THE INVENTION

1. Field of the Invention

This invention relates to a hoisting device for a crane, more particularly to a hoisting device with a hanging unit which is rotatable and adjustable to a desired angular position.

2. Description of the Related Art

In the conventional way of transporting an article to a desired location with the use of a crane, cables on the crane are fastened to a hoisting device. The hoisting device has a hook hung therefrom, and the hook holds together the top ends of four hanging chains. The bottom ends of the hanging chains extend away from each other and are fastened to the corners of the article. In construction sites, it is frequent to hoist a modular form assembly into a building or from floor to floor with the use of a crane and then position the same at a location where concrete will be formed. When the form assembly is hung on the hoisting device, it would normally rotate. In order to place the form assembly in a proper position, the position of the form assembly must be manually controlled and adjusted by operators when the form assembly is unloaded from the hook of the hoisting device. However, because of its bulky volume and heavy weight, handling of the form assembly is difficult to be conducted by operators.

SUMMARY OF THE INVENTION

The main object of the present invention is to provide a hoisting device which can rotate the article hung thereon to correct the angular position of the article.

According to this invention, a rotatable hoisting device includes a hanging unit with a hook, and a rotary shaft which is connected to the hanging unit. The rotary shaft is driven by a power drive unit for rotating and adjusting the hanging unit, thereby rotating the form hung on the hook to a desired angular position before it is positioned.

BRIEF DESCRIPTION OF THE DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
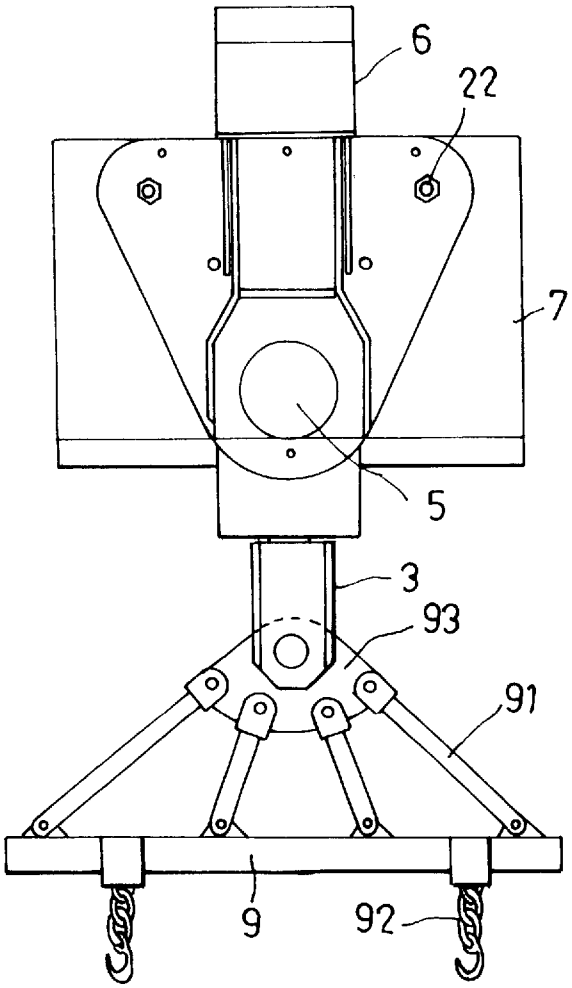
FIG. 1 is a schematic view of a preferred embodiment of a hoisting device according to the present invention.
Figure 2:
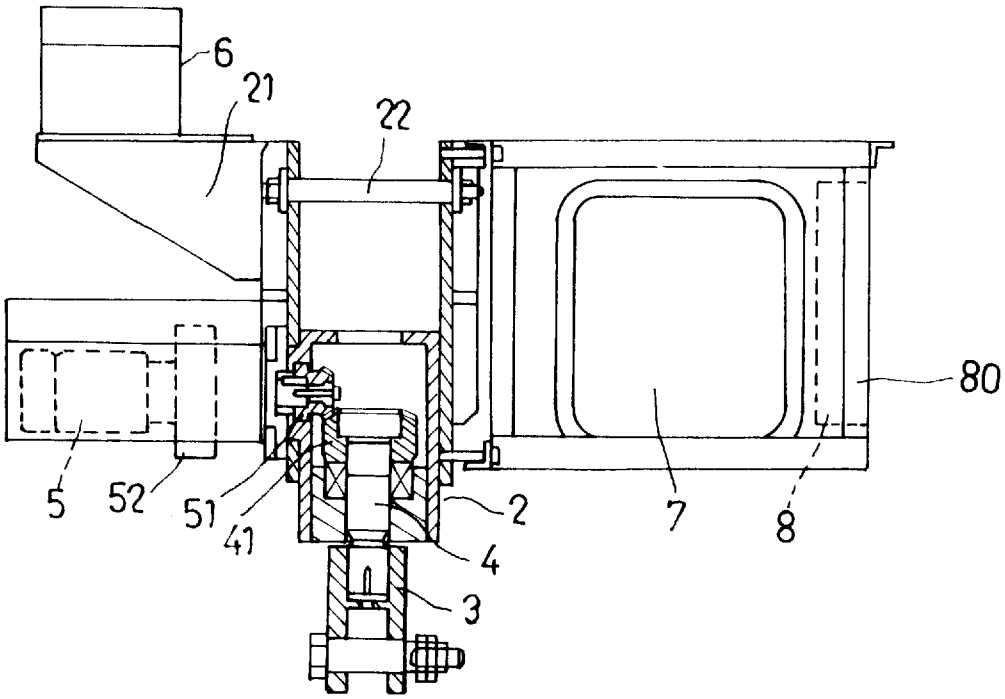
FIG. 2 is a side view of the hoisting device of FIG. 1.

Referring to FIGS. 1 and 2, the preferred embodiment of a hoisting device according to the present invention is shown to comprise an intermediate casing 2, and a holding unit 3 which is secured to a rotary shaft 4 mounted inside the intermediate casing 2. The rotary shaft 4 extends outward and downward from the intermediate casing 2. A first bevel gear 41 is mounted on the rotary shaft 4 and engages a second bevel gear 51 which is driven by a motor 5. The motor 5 is mounted to one side of the intermediate casing 2. A speed reducing gear mechanism 52 is disposed between the motor 5 and the second bevel gear 51 so as to reduce the output speed of the motor 5 and transmit the output of the motor 5 to the rotary shaft 4. A holding seat 21 is mounted on the intermediate casing 2 above the motor 5 for holding a counterweight 6. A side casing 80 is mounted on the other side of the intermediate casing 2 opposite to the motor 5 for holding an electric generator 7 and a control box 8 which are connected to the motor 5 for controlling the operation of the same. A connecting rod 22 is provided above the intermediate casing 2 for interconnecting the side casing 80 and the holding seat 21.

A hanging unit includes a hanging bar 9, two hooks 92 which are slidably mounted to the hanging bar 9, and a plurality of hanging rods 91 which are spacedly pivoted to the hanging bar 9 at their lower ends and which are mounted to a mounting bracket 93 at their upper ends. The mounting bracket 93 is connected to the holding unit 3.

In operation, the hooks 92 have a form hung thereon for lifting and moving the same, and the connecting rod 22 is connected to a crane (not shown). The form is lifted and moved toward upper of a desired location. At this time, a ground operator may operate a switch (not shown) of the control box 8 via a remote controller to start the motor 5. The motor 5 drives the rotary shaft 4 through the speed reducing gear mechanism 52 and the bevel gears 51, 41 to rotate and adjust the form to a proper angular position. Therefore, with the hoisting device of this invention, the form can be rotated and adjusted to a desired angular position before it is positioned. The operation for positioning the form is thus facilitated.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A rotatable hoisting device for a crane, comprising:

a hanging unit comprising a hanging bar and at least a pair of hooks slidably mounted to said hanging bar, wherein said hanging unit further comprises a mounting bracket connected to a holding unit and a plurality of hanging rods having upper and lower ends, wherein said rods are spacedly pivoted to said hanging bar at the lower ends and mounted to said mounting bracket at the upper ends;

a rotary shaft connected to said hanging unit for rotating and adjusting said hanging unit to a certain angular position; and a power drive unit for driving said rotary shaft.

2. The rotatable hoisting device as claimed in claim 1, wherein said power drive unit comprises an electric generator, a motor in connection with said electric generator, and a gear assembly for transmitting output of said motor to said rotary shaft.

3. The rotatable hoisting device as claimed in claim 2, wherein said gear assembly comprises a speed reducing gear mechanism.

4. The rotatable hoisting device as claimed in claim 3, wherein said gear assembly further comprises a first bevel gear which is mounted on said rotary shaft, and a second bevel gear which is driven by said motor, said speed reducing gear mechanism being disposed between said motor and said second bevel gear.

5. A rotatable hoisting device for a crane, comprising:

a hanging unit having a hook;

a rotary shaft connected to said hanging unit for rotating and adjusting said hanging unit to a certain angular position;

a power drive unit for driving said rotary shaft comprising an electric generator, a motor in connection with said electric generator, and a gear assembly for transmitting output of said motor to said rotary shaft, wherein said gear assembly comprises a speed reducing gear mechanism; and an intermediate casing for housing said gear assembly and said rotary shaft, said rotary shaft extending outward and downward from said intermediate casing for connection with said hanging unit.

6. A rotatable hoisting device for a crane, comprising:

a hanging unit having a hook;

a rotary shaft connected to said hanging unit for rotating and adjusting said hanging unit to a certain angular position;

a power drive unit for driving said rotary shaft comprising an electric generator, a motor in connection with said electric generator, and a gear assembly for transmitting output of said motor to said rotary shaft, wherein said gear assembly comprises a speed reducing gear mechanism;

an intermediate casing for housing said gear assembly and said rotary shaft, said rotary shaft extending outward and downward from said intermediate casing for connection with said hanging unit; and a side casing mounted to one side of said intermediate casing for holding said electric generator, said motor being mounted to the other side of said intermediate casing opposite to said side casing, said hoisting device further comprising a counterweight mounted to said intermediate casing above said motor.

* * * * *